US006648163B2

(12) United States Patent
Porter, III et al.

(10) Patent No.: US 6,648,163 B2
(45) Date of Patent: Nov. 18, 2003

(54) PACKAGE HAVING CUP WITH BEVELED SEALING FLANGE

(75) Inventors: James A. Porter, III, Clayton, CA (US); Terry L. Koberstein, Antioch, CA (US); David K. Cosgrove, Williamsburg, VA (US)

(73) Assignee: Del Monte Corporation, San Francisco, CA (US)

( * ) Notice: Subject to any disclaimer, the term of this patent is extended or adjusted under 35 U.S.C. 154(b) by 0 days.

(21) Appl. No.: 09/944,733

(22) Filed: Aug. 31, 2001

(65) Prior Publication Data

US 2003/0042259 A1 Mar. 6, 2003

(51) Int. Cl.[7] ..... B65D 17/34

(52) U.S. Cl. ..... 220/359.2; 220/359.4; 229/123.1; 426/123

(58) Field of Search ..... 220/656, 657, 220/659, 359.1, 359.2, 359.4, 359.5, FOR 186, 359.3, DIG. 31; 215/12.1, 232; 206/484, 467; 229/3.5 R, 123.1; 426/123

(56) References Cited

U.S. PATENT DOCUMENTS 3,185,371 A * 5/1965 Reifers ..... 220/659
4,605,142 A * 8/1986 Itoh et al. ..... 220/359.4
4,762,246 A 8/1988 Ashley et al.
4,787,527 A * 11/1988 Monetti ..... 220/557
4,828,112 A * 5/1989 Vollrath et al. ..... 206/519
4,836,380 A 6/1989 Walter et al.
5,039,001 A * 8/1991 Kinigakis et al. ..... 220/359.3
6,082,533 A * 7/2000 Smith et al. ..... 206/210

* cited by examiner

*Primary Examiner*—Robin Hylton
(74) *Attorney, Agent, or Firm*—Dorsey & Whitney LLP

(57) ABSTRACT

A package for foodstuffs including a cup and a lid. The cup includes an opening surrounded by a flange. The flange has a sealing surface adjacent the opening and a beveled surface spaced outwardly of the sealing surface. The beveled surface extends along a periphery of the flange. The sealing surface has an inner radius $R_1$ and an outer radius $R_2$, the outer radius $R_2$ defining the juncture between the sealing surface and the beveled surface. The beveled surface extends at a predetermined angle with respect to the sealing surface. The lid includes a tab extending outward of the periphery of the flange. The lid is affixed to the sealing surface thereby sealing the opening of the cup. The lid is not affixed to a substantial portion of the beveled surface. The lid and the sealing surface are adapted to release upon exertion of a predetermined pulling force on the tab.

22 Claims, 1 Drawing Sheet

PACKAGE HAVING CUP WITH BEVELED SEALING FLANGE

BACKGROUND OF THE INVENTION

1. Field of the Invention

The present invention relates to a new and improved package for foodstuffs. More particularly, the present invention relates to a package having a cup with a beveled sealing flange.

2. Description of Related Art

A wide variety of hermetically sealed packages suitable for containing foodstuffs are known. One conventional package widely used for containing foodstuffs includes a plastic cup having a removable film seal. In particular, the plastic cup includes a sealing flange to which the removable film seal is attached.

Preferably, the cup and the film seal of the conventional package are adapted to allow a consumer to open the package, that is, remove the film seal from the cup with minimal effort to gain access to the foodstuffs contained within the package. The film seal can be engineered to provide a reduced peel level or predetermined amount of force required to remove the film seal from the cup. However, reducing the peel level disadvantageously affects other critical functional requirements of the package. For example, reducing the peel level proportionately increases the possibility of the package bursting and/or leaking. Re-engineering the film seal is insufficient to effect a significant reduction in the opening force of the package because conventional sealing equipment has a wide variation of operating parameters, including temperature, seal time, pressure and other factors, which must be considered when designing the package. In addition to the sealing equipment, a thermo-processing environment (retort) must be compatible with the materials of the package.

Conventional packing and sealing equipment is generally standardized to accommodate cups having a one-quarter inch sealing flange. Disadvantageously, the use of a one-quarter inch sealing flange provides a rather large contact area between the film seal and the cup thus requiring a considerable amount of force on the part of a consumer to remove the film seal from the cup. Although use of a narrow flange has been contemplated, it has been determined that narrow flanges are not compatible with current tooling. In particular, due to the inherent play found in conventional sealing equipment, use of a smaller, for example, a one-eighth inch sealing flange is insufficient to properly seal the film seal to the cup. Although, such configuration may reduce the amount of force necessary to remove the film seal from the cup, such configuration is insufficient to overcome pressures exerted upon the packages during retorting, shipping and distribution which may disadvantageously blow the film seal off the cup, or otherwise result in a leaking seal.

What is needed is a new and improved package for foodstuffs which overcomes the above and other disadvantages of known packages.

SUMMARY OF THE INVENTION

In summary, one aspect of the present invention is directed to a package for foodstuffs. The package generally includes a cup and a lid. The cup includes an opening surrounded by a flange. The flange has a sealing surface adjacent the opening and a beveled surface spaced outwardly of the sealing surface. The beveled surface extends along a periphery of the flange. The sealing surface has an inner radius $R_1$ and an outer radius $R_2$, the outer radius $R_2$ which defines the juncture between the sealing surface and the beveled surface. The beveled surface extends at a predetermined angle with respect to the sealing surface. The lid includes a tab extending outward of the periphery of the flange. The lid is affixed to the sealing surface thereby sealing the opening of the cup. The lid is not affixed to a substantial portion of the beveled surface.

The lid and the sealing surface are adapted to release upon exertion of a predetermined pulling force on the tab. The predetermined pulling force is less than approximately 8 pounds and is preferably approximately 3 to 5 pounds.

An object of the present invention is to provide a new and improved package suitable for containing foodstuffs and other substances.

Yet another object of the present invention is to provide a package including a lid and a cup having a reduced contact area while maintaining the overall dimensions of the cup.

It is a further object of the present invention to provide a packaging adapted for reducing the amount of force on the part of a consumer and/or user required to remove the lid from the cup while maintaining the structural integrity of the package.

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
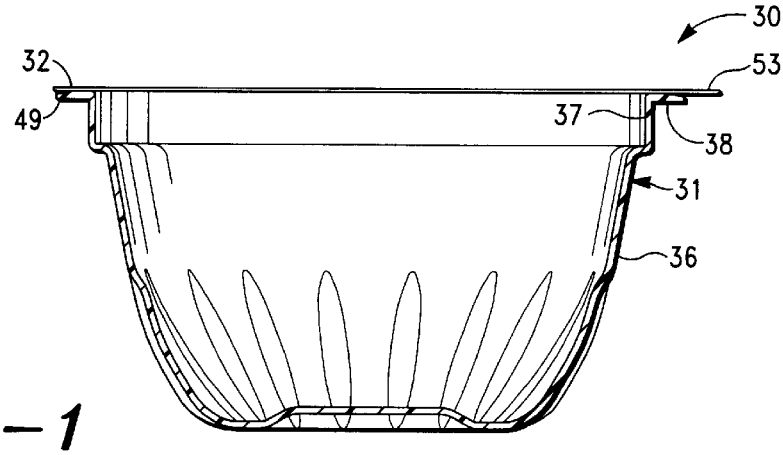
FIG. 1 is a side elevational view of a package for foodstuffs in accordance with the present invention, the package including a cup and a lid affixed to the cup.
Figure 2:
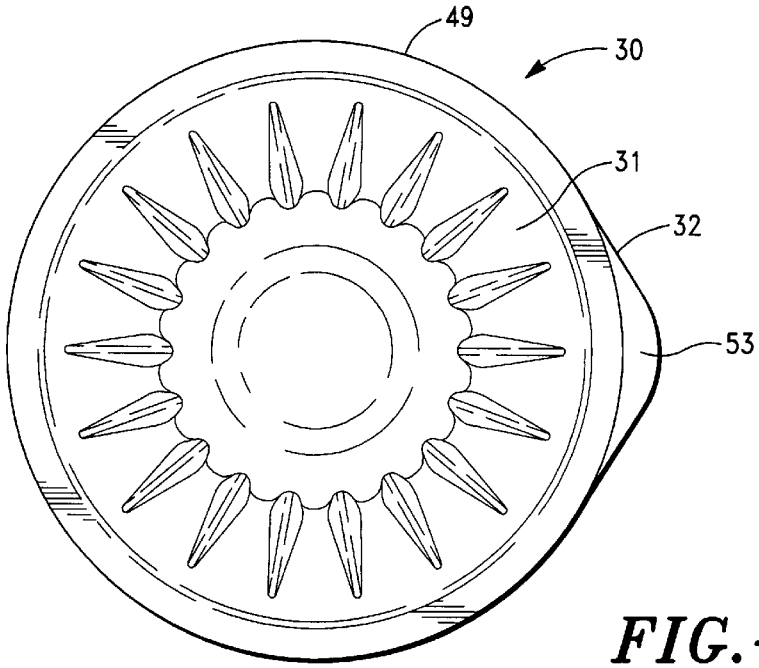
FIG. 2 is a bottom plan view of the cup and lid shown in FIG. 1.

Turning now to the drawings, wherein like components are designated by like reference numerals throughout the various figures, attention is directed to FIGS. 1 and 2 which illustrate a package 30 for foodstuffs in accordance with the present invention. Package 30 is particularly suited for containing single-serving portions of fruits and other foodstuffs. Generally, package 30 includes a cup 31 and a lid 32. In the illustrated embodiment, cup 31 and lid 32 are circular, however, one should appreciate that other shapes can be utilized in accordance with the present invention. In particular, the sealing flange of the cup can be oval, triangular, square, rectangular, or any other suitable shape.

Cup 31 of the present invention includes a thin-walled receptacle 36, an opening 37 formed in receptacle 36, and a sealing flange 38 which surrounds the opening in a manner similar to that of conventional packages. In one embodiment of the present invention, cup 31 is formed of plastic and is preferably formed of polypropylene. One should appreciate, however, that other suitable materials can be used in accordance with the present invention.

Figure 3:
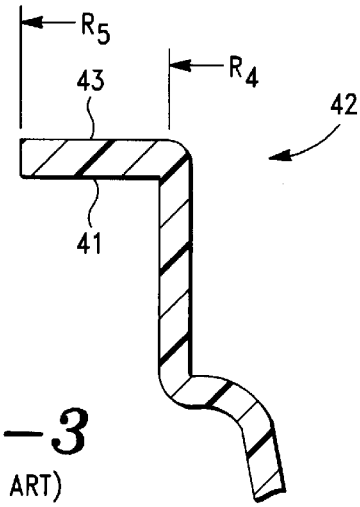
FIG.–3 (PRIOR ART)
FIG. 3 is an enlarged detailed view of a portion of a prior art package for foodstuffs.
Figure 4:
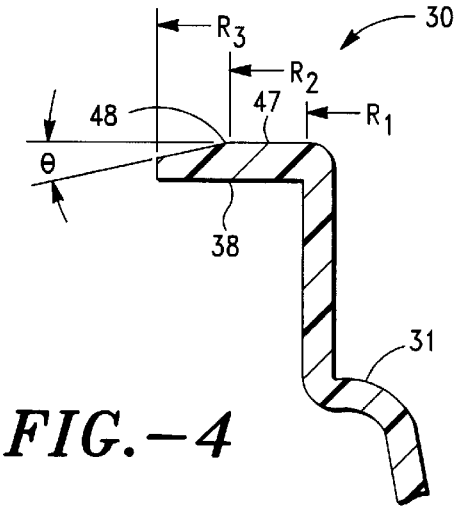
FIG. 4 is an enlarged detailed view of a portion of the cup of the present invention shown in FIG. 1.

Unlike the sealing flange 41 of a prior art package 42 which has a planar sealing surface 43, as shown in FIG. 3, sealing flange 38 of the present invention includes a substantially planar inner sealing surface 47 adjacent opening 37 and an outer beveled surface 48 spaced outwardly of sealing surface 47, as shown in FIG. 4. In particular, beveled surface 48 extends along a periphery 49 of sealing flange 38 outside of sealing surface 47 and extends downwardly and outwardly from inner sealing surface 47 of sealing flange 38.

Beveled surface 48 extends at an angle with respect to the sealing surface. In one embodiment, beveled surface 48 extends at an angle of approximately 8° to 12°, and more preferably, approximately 10°.

The illustrated embodiment includes a beveled surface that is substantially linear and forms a frustoconical surface. One should appreciate that the slope of the beveled surface need not be linear but instead can be curved in accordance with the present invention. For example, the beveled surface can form a concave juncture or fillet between the sealing surface and the outer peripheral edge of the sealing flange, provided the beveled surface is substantially remote from the lid. Alternatively, the beveled surface can form a convex juncture or rounded chamfer between the sealing surface and the outer peripheral edge. One should appreciate that, in the case a curved profile is utilized, the profile preferably extends uniformly around the circumference of the flange in order to minimize inconsistency and the possibility of leakage.

Sealing surface 47 has an inner radius $R_1$ and an outer radius $R_2$. The outer radius $R_2$ defines the juncture between sealing surface 47 and beveled surface 48.

The difference $R_\Delta$ between the outer radius $R_2$ and the inner radius $R_1$ can vary in accordance with present invention but is less than the width of the flange. Preferably the difference $R_\Delta$ between the outer radius $R_2$ and the inner radius $R_1$ is between approximately 0.080 inches and 0.120 inches. For example, the difference between the outer radius $R_2$ and the inner radius $R_1$ can be approximately 0.080 inches, approximately 0.100 inches, approximately 0.120 inches, or other suitable dimension in order to provide a desired predetermined pulling force required for a consumer to remove lid 32 from cup 31, as discussed below.

In one embodiment of the present invention, lid 32 includes a flexible seal film that is composed of multiple layers. Preferably, the film seal of lid 32 includes at least layer one that is impermeable to air and thus forms an oxygen barrier layer for hermetically sealing a foodstuff within the package 30. Preferably, the film of lid 32 includes an adhesive bonding agent to facilitate attaching lid 32 to cup 31. Alternatively, the lid can be affixed to the sealing surface with an endless weld or other suitable means within the scope of the present invention.

Lid 32 includes a tab 53 which extends outwardly of periphery 49 of sealing flange 38. Lid 32 is adhesively affixed to sealing surface 47 of sealing flange 38 thereby sealing opening 37 of cup 31. Importantly, lid 32 is not affixed to at least a substantial portion of beveled surface 48. Preferably, lid 32 is not affixed to any portion of beveled surface 48. However, one should appreciate that lid 32 may inadvertently be affixed to a minimal portion of the beveled surface due to the inherent play and tolerances found in conventional packing and sealing equipment. Preferably, lid 32 contacts no more than approximately 10% of beveled surface 48, and most preferably no more than approximately 20% of the beveled surface.

The configuration of sealing flange 38 of the present invention provides a package in which a desired predetermined pulling force of less than approximately 8 pounds, and preferably between approximately 3 to 5 pounds, as necessary to remove lid 32 from cup 31. In particular, a consumer and/or user can grip tab 53 and pull the tab away from sealing flange 38 of cup 32 with minimal effort. For example, in one embodiment, the package has a pulling force of approximately 6 to 8 pounds as determined by a pull test conducted with a 23° angle, full panel peel test on the cup.

Lid 32 is sealed to cup 31 with conventional packing and sealing equipment. In one embodiment of the present invention, lid 32 is sealed to cup 31 at approximately 375° F. utilizing an approximate 0.70 second dwell-time, and at approximately 50 psi equipment conditions. Preferably, package 30, as well as the foodstuffs contained therein, are prepared in a retort environment. Preferably, package 30 is also designed and configured to withstand temperatures to 230° F. and pressures up to two bars. One should appreciate, however, that the package need not be prepared in a retort environment.

Sealing flange 38 is modified in such a way that the overall contact area between lid 32 and flange 38 of cup 31 is reduced without reducing the overall dimension of sealing flange 38. In particular, beveled surface 48 reduces the area of sealing surface 47 thus reducing the overall contact area between lid 32 and sealing surface 47. For example, the overall dimension of sealing flange 38, that is, the outside radius $R_3$ of sealing flange 38 does not differ from that of prior art sealing flange 41 of the prior art package shown in FIG. 3. However, the total contact area between lid 32 and sealing flange 38 of the present invention is significantly less that than of the prior art package shown in FIG. 3.

The total contact area between lid 32 and sealing flange 38 of the present invention is the substantially planar area of sealing surface 47 which is defined by inner radius $R_1$ and outer radius $R_2$, as shown in FIG. 4. In contrast, the total contact area of prior art sealing flange 41 is the entire sealing surface 43 which is defined by the inside radius $R_4$ and the outside radius $R_5$ of sealing flange 41, as shown in FIG. 3. The total contact area between lid 32 and sealing flange 38 of the present invention is significantly reduced as compared to prior art configurations. In one embodiment, the total contact area is approximately one-quarter square inch. Preferably, the total contact area is less than 0.25 square inches. The reduced contact area configuration reduces the opening force required by a consumer to pull and peel lid 32 away from cup 31 by approximately 15% to 20% while maintaining finished product integrity.

A critical functional requirement for the package of the present invention is to maintain a package integrity having a burst value, as determined by a restrained burst test with ⅛ inch gap in the tester, of at least approximately 8 psi, and preferably approximately 9 psi burst value. In particular, the configuration of the sealing flange of the present invention provides a design that withstands pressures which may be encountered during shipping and distribution of the package. For example, the sealing flange of the present invention provides a design which withstands a predetermined burst value of at least approximately 9 psi. This configuration also minimizes leakage of the package after retort. For example, the sealing flange of the present invention may provide a configuration in which leakage occurs in less than one package in 4000 following assembly of the cup and lid and after retort.

In operation and use a consumer and/or user grips tab 53 of lid 32 and pulls lid 32 away from cup 31 in order to gain access to the contents contained within package 30. The consumer can partially or entirely remove lid 32 from cup 31 in order to access the contents of the package in a well known manner.

As noted above, the package of the present invention is designed configured to allow the consumer to remove the lid from the cup using minimal force. For example, the amount of force required on the part of the consumer to pull and peel lid 32 away from cup 31 preferably ranges from approximately six pounds to eight pounds.

Advantageously, sealing flange 38 of the present invention provides a configuration which reduces the opening force required by a consumer to open package 30 while maintaining the structural integrity of package 30. As noted above, sealing flange 38 is modified in such a way that the overall contact area between lid 32 and flange 38 of cup 31 is reduced without reducing the overall dimension of sealing flange 38.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A package for foodstuffs comprising;

a cup having an opening surrounded by a flange, said flange having a substantially planar inner sealing surface adjacent said opening and an outer beveled surface spaced outwardly of said sealing surface, said beveled surface extending along a periphery of said flange; and a lid having a tab extending outward of said periphery of said flange, said lid affixed to said substantially planar inner sealing surface thereby sealing said opening of said cup.

2. The package of claim 1 wherein said lid is not affixed to a substantial portion of said beveled surface.

3. The package of claim 1 wherein said lid is not affixed to said beveled surface.

4. The package of claim 1 wherein said beveled surface extends at an angle of at least approximately 8° with respect to said sealing surface.

5. The package of claim 1 wherein said beveled surface extends at an angle of approximately 10° with respect to said sealing surface.

6. The package of claim 1 wherein said beveled surface extends at an angle of less than approximately 12° with respect to said sealing surface.

7. The package of claim 1 wherein said sealing surface has an inner radius($R_1$) and an outer radius($R_2$) said outer radius($R_2$) defining the juncture between said sealing surface and said beveled surface.

8. The package of claim 7 wherein the difference between said outer radius($R_2$) and said inner radius($R_1$) is at least approximately 0.080 inches.

9. The package of claim 7 wherein the difference between said outer radius($R_2$) and said inner radius($R_1$) is approximately 0.100 inches.

10. The package of claim 7 wherein the difference between said outer radius($R_2$) and said inner radius($R_1$) is less than approximately 0.120 inches.

11. The package of claim 1 wherein said lid and said sealing surface are adapted to release upon exertion of a predetermined pulling force on said tab.

12. The package of claim 11 wherein said predetermined pulling force is approximately 6 to 8 pounds.

13. The package of claim 11 wherein said predetermined pulling force is approximately 3 to 5 pounds.

14. The package of claim 1 wherein said lid comprises an oxygen barrier.

15. The package of claim 1 wherein said lid is affixed to said sealing surface by an adhesive bonding agent.

16. The package of claim 1 wherein said lid is affixed to said sealing surface by an endless weld.

17. The package of claim 1 wherein said cup is plastic.

18. The package of claim 1 wherein said cup is round.

19. A package for foodstuffs comprising;

a cup having an opening surrounded by a flange, said flange having a substantially planar inner sealing surface adjacent said opening and a beveled surface spaced outwardly of said sealing surface, said beveled surface extending along a periphery of said flange; and a lid having a tab extending outward of said periphery of said flange, said lid affixed to 1said substantially planar inner sealing surface thereby sealing said opening of said cup, wherein said lid is not affixed to a substantial portion of said beveled surface, wherein said lid and said sealing surface are adapted to release upon exertion of a predetermined pulling force on said tab of approximately 6 to 8 pounds.

20. The package of claim 19 wherein said beveled surface extends at an angle of at approximately 8° to 12° with respect to said sealing surface.

21. The package of claim 19 wherein said sealing surface has an inner radius($R_1$) and an outer radius($R_2$) said outer radius($R_2$) defining the juncture between said sealing surface and said beveled surface, wherein the difference between said outer radius($R_2$) and said inner radius($R_1$) is in the range of approximately 0.080 inches and approximately 0.120 inches.

22. The package of claim 19 wherein said predetermined pulling force is approximately 3 to 5 pounds.

* * * * *

UNITED STATES PATENT AND TRADEMARK OFFICE

CERTIFICATE OF CORRECTION

PATENT NO. : 6,648,163 B2
DATED : November 18, 2003
INVENTOR(S) : James A. Porter III et al.

It is certified that error appears in the above-identified patent and that said Letters Patent is hereby corrected as shown below:

Column 6,
Line 40, delete "1".

Signed and Sealed this

Twenty-seventh Day of April, 2004

JON W. DUDAS
*Acting Director of the United States Patent and Trademark Office*